United States Patent [19]

Sanders

[11] Patent Number: 4,899,479

[45] Date of Patent: Feb. 13, 1990

[54] SHOTGUN RIB MOUNT

[76] Inventor: Ronald J. Sanders, P.O. Box 658, Floodwood, Minn. 55736

[21] Appl. No.: 240,753

[22] Filed: Sep. 2, 1988

[51] Int. Cl.[4] ..... F41G 1/46

[52] U.S. Cl. ..... 42/102; 42/103

[58] Field of Search ..... 42/100, 101, 102, 103; 33/233, 234, 244, 245–250; 248/225.31, 316.1, 316.8

[56] References Cited

U.S. PATENT DOCUMENTS

| | | | |
|---|---|---|---|
| 2,499,611 | 3/1950 | Sklarek | 248/225.31 |
| 4,008,536 | 2/1977 | Adams | 42/100 |
| 4,143,465 | 3/1979 | White | 33/233 |
| 4,567,683 | 2/1986 | Buehler | 42/101 |
| 4,734,989 | 4/1988 | Sanders | 33/244 |

*Primary Examiner*—Deborah L. Kyle
*Assistant Examiner*—Michael J. Carone
*Attorney, Agent, or Firm*—Peterson, Wicks, Nemer & Kamrath

[57] ABSTRACT

A mounting device for the purpose of mounting various sighting apparatus on the raised vented rib of shotguns and various other weapons is disclosed. A mounting device that attaches to any suspended rail is disclosed. The device is characterized by a channeled piece of material designed to customly accept a flat plate of material within the inner surface walls of the extending arms of said channel and connected together by screws through mating holes to create a clamp-like device when the flat plate of material is placed beneath the suspended rail and the channel piece is placed on top of the suspended rail and mated to the flat plate and drawn together with screws to create a mounting surface on top of the suspended rail for use with various sighting apparatus. The device is affixed with centering and alignment means and braces that allow for adjusting to the various distances between the suspending posts of the rail, for stabilizing and for recoil absorption. The device can be formed, shaped and otherwise configured to work in conjunction with other practical mounting methods.

24 Claims, 2 Drawing Sheets

SHOTGUN RIB MOUNT

BACKGROUND OF THE INVENTION

Shotguns and other various weapons are often manufactured with what is known as a vented rib, which is a suspended rail that is centered on and extends the length of the barrel of said weaponry. The vented rib limits the means to support various sighting apparatus that are designed to be mounted or maintained with a longer relief or distance from a user's eye. In many instances, because of this limitation, relief oriented sighting apparatus are mounted too close to the user's eye and become awkward, inoperable or at best difficult to use with their intended precision. This invention then relates to the making of a more effective and desirable way to mount the various sighting apparatus that are currently manufactured for use with an intended longer eye relief. This invention can be affixed with and used in conjunction with many practical mounting means.

Although the features of this invention which are believed to be novel are set forth in the claims, details as to its organization and method of operation, together with the further objects and advantages thereof, may be best understood through reference to the following description taken in connection with the accompanying drawings, wherein:

DESCRIPTION OF THE PREFERRED EMBODIMENTS

Figure 1:
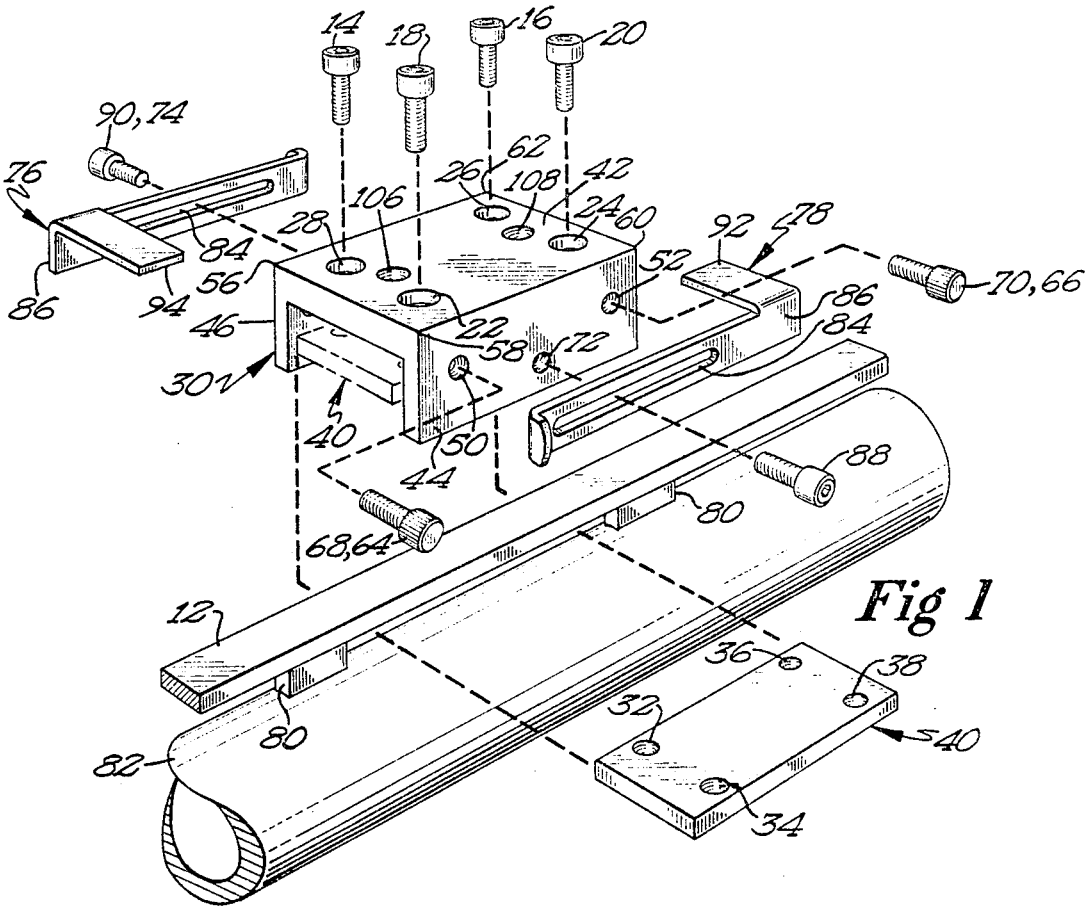
FIG. 1 is an exploded perspective view consisting of the mounting system as it would appear to mount on the raised vented rib of a shotgun barrel.
Figure 2:
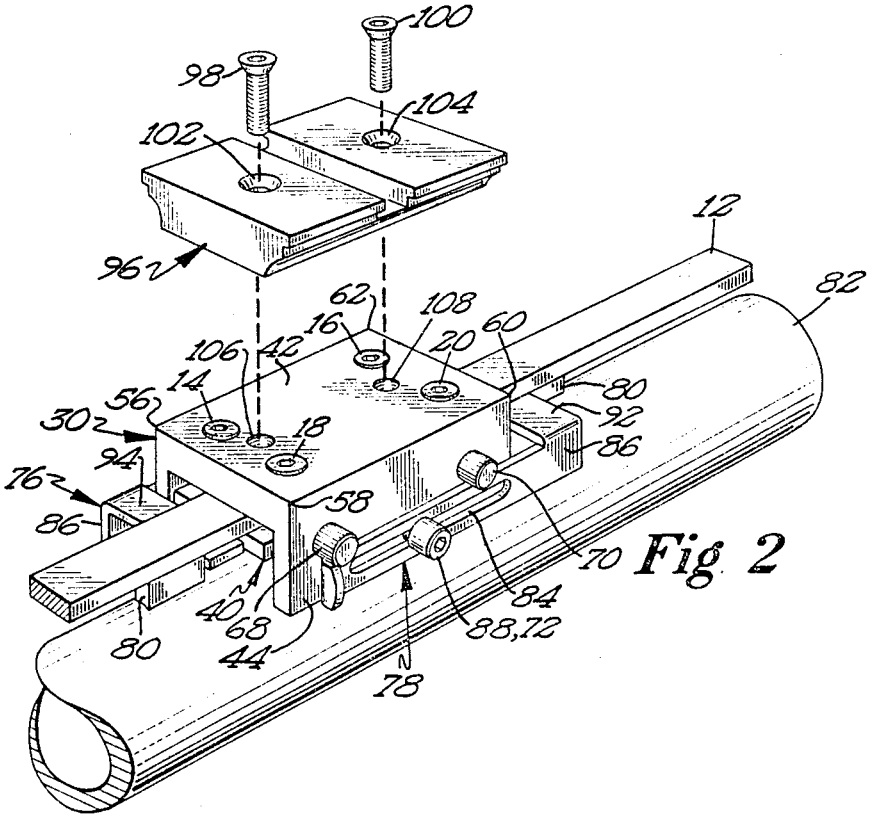
FIG. 2 is an exploded perspective view consisting of the mounting system as it would appear when mounted on the raised vented rib of a shotgun barrel along with a dovetail scope ring attachment exploded therefrom.

Referring now to the drawings in detail, wherein like numerals indicate like elements throughout the several views, FIGS. 1 and 2 illustrate a mounting device for use with sighting apparatus on the raised vented rib, generally designated by the numeral 12, of various weapons. Device attaches to raised vented rib 12 by four threaded screws 14, 16, 18 and 20 as they pass through countersunk clearance holes 22, 24, 26 and 28 in mounting base 30 and are received by the four threaded holes 32, 34, 36 and 38 in clamping plate 40 and then drawn tight against raised vented rib 12. Mounting base 30 is a channeled piece of material, preferrably a non-corrosive metal, with a flat surface 42 and two extended arm surfaces 44 and 46. Mounting base 30 has at least four countersunk clearance holes 22, 24 26 and 28 on its flat surface 42 and four threaded holes 50 and 52 at the four outer corners 56, 58, 60 and 62 on the arm surfaces 44 and 46 that accept four threaded screws 64, 66, 68 and 70 for centering and adjusting mounting base 30 on raised vented rib 12. Extended arm surfaces 44 and 46 also have threaded holes 72 and 74 for the purpose of adapting extension and recoil braces 76 and 78, which help stabilize and reduce recoil shock to the various sighting apparatus which can be attached to mounting base 30 by extending in either direction and bracing against the raised vented rib carriage post 80 which elevates raised vented rib 12 from the barrel 82 of the weapon. Clamping plate 40 is a flat plate of metallic material with four threaded holes 32, 34, 36 and 38 shaped to fit beneath mounting base 30 and align with and accept the four threaded screws 14, 16, 18 and 20 as they pass through the countersunk clearance holes 22, 24, 26 and 28 on the flat surface 42 of mounting base 30. The extension braces 76 and 78 are angle shaped of a metallic material and are characterized by a long slot 84 in the center of the flat wall 86 which allows them to extend or retract after being attached to the two extended arm surfaces 44 and 46 of mounting base 30 by two threaded screws 88 and 90. The angled flat surfaces 92 and 94 of recoil braces 76 and 78 fit between raised vented rib 12 and weapon barrel 82 and adjust along slot 84 to brace against raised vented rib carriage post 80.

Whereas in FIG. 1, mounting base 30, clamping plate 40 and extension recoil braces 76 and 78 create the main structure of a mounting base in FIG. 2. The mounting base 30 is shown with a standard dovetail scope ring attachment base 96 which can be adapted to the flat surface 42 of mounting base 30 and can then be used in conjunction with standard and readily available scope ring clamps. The dovetail scope ring attachment base 96 can be mounted to the flat surface 42 of mounting base 30 by passing threaded screws 98 and 100 through clearance holes 102 and 104 in dovetail scope ring attachment base 96 and secured to mating threaded holes 106 and 108 in center of flat surface 42 of mounting base 30.

It is obvious that a new mounting system for sighting apparatus on raised vented rib weapons is hereby created and can be a valuable accessory used by sportsmen, shooters, etc. to get full benefit from relief oriented sighting apparatus currently available.

It should be understood that the specific embodiments of the invention herein disclosed are of a descriptive rather than a limiting nature, and that various changes, combinations, substitutions or modifications may be employed in accordance with these teachings without departing either in spirit or scope from this invention in its broader aspects.

What is claimed is:

1. Device for mounting sighting apparatus comprising, in combination: a weapon having a raised vented rib; an upper plate for resting on top of the raised vented rib; a lower plate for placement beneath the raised vented rib and between the raised vented rib and the weapon; and means for drawing the upper plate and the lower plate together to clamp the upper plate and the lower plate to the raised vented rib.

2. The mounting device of claim 1 wherein the drawing means comprises at least first and second threaded screws, with the upper plate including at least first and second clearance holes, with the lower plate including at least first and second threaded holes aligned with the first and second clearance holes, with the first and second clearance holes located on opposite sides of the raised vented rib, with the first and second threaded holes located on opposite sides of the raised vented rib, with the first and second threaded screws passing through the clearance holes of the upper plate and being threadably received in the threaded holes of the lower plate to draw the lower plate toward the upper plate.

3. The mounting device of claim 2 further comprising in combination: means for centering and aligning the upper plate on top of the raised vented rib.

4. The mounting device of claim 3 wherein the centering and aligning means comprises, in combination: at least a first side surface extending from the upper plate;

and means affixed to the side surface for adjusting the upper plate on the vented rib.

5. The mounting device of claim 4 wherein the adjusting means comprises at least a first screw threadably received in the side surface for abutting with the raised vented rib.

6. The mounting device of claim 5 wherein the centering and aligning means further comprises, in combination: a second side surface, with the upper plate and the first and second side surfaces forming a channel.

7. The mounting device of claim 3 further comprising, in combination: at least a first stabilization and recoil reduction brace affixed to the upper plate.

8. The mounting device of claim 7 wherein the raised vented rib is elevated from the weapons by a post; and wherein the stabilization and recoil reduction brace comprises, in combination: a flat wall affixed to the upper plate; and a flat surface angled from the flat wall to fit between the raised vented rib and the weapon and to brace against the post.

9. The mounting device of claim 8 wherein the stabilization and recoil reduction brace further comprises, in combination: a slot formed in the flat wall, with the stabilization and recoil reduction brace affixed to the upper plate by a screw passing through the slot and threadably received in the upper plate allowing the flat wall to be extended and retracted relative to the upper plate.

10. Device for mounting sighting apparatus on weapons having a raised vented rib comprising, in combination: an upper plate for resting on top of the raised vented rib; a lower plate for placement beneath the raised vented rib and between the raised vented rib and the weapon; and means for drawing the upper plate and the lower plate together to clamp the upper plate and the lower plate to the raised vented rib comprising at least first and second threaded screws, with the upper plate including at least first and second clearance holes, with the first and second clearance holes of the upper plate being countersunk, with the lower plate including at least first and second threaded holes aligned with the first and second clearance holes, with the first and second clearance holes located on opposite sides of the raised vented rib, with the first and second threaded holes located on opposite sides of the raised vented rib, with the first and second threaded screws passing through the clearance holes of the upper plate and being threadably received in the threaded holes of the lower plate to draw the lower plate toward the upper plate.

11. Device for mounting sighting apparatus on weapons having a raised vented rib comprising, in combination: an upper plate for resting on top of the raised vented rib; a lower plate for placement beneath the raised vented rib and between the raised vented rib and the weapon; means for drawing the upper plate and the lower plate together to clamp the upper plate and the lower plate to the raised vented rib; and means for removably mounting attachment bases of the sighting apparatus to the upper plate.

12. The mounting device of claim 11 wherein the removably mounting means comprises at least a first threaded hole formed in the upper plate.

13. Device for mounting sighting apparatus on weapons having a raised vented rib comprising, in combination: an upper plate for resting on top of the raised vented rib; a lower plate for placement beneath the raised vented rib and between the raised vented rib and the weapon; means for drawing the upper plate and the lower plate together to clamp the upper plate and the lower plate to the raised vented rib; and means for centering and aligning the upper plate on top of the raised vented rib.

14. The mounting device of claim 13 wherein the centering and aligning means comprises, in combination: at least a first side surface extending from the upper plate; and means affixed to the side surface for adjusting the upper plate on the vented rib.

15. The mounting device of claim 14 wherein the adjusting means comprises at least a first screw threadably received in the side surface for abutting with the raised vented rib.

16. The mounting device of claim 15 wherein the centering and aligning means further comprises, in combination: a second side surface, with the upper plate and the first and second side surfaces forming a channel.

17. Device for mounting sighting apparatus on weapons having a raised vented rib comprising, in combination: an upper plate for resting on top of the raised vented rib; a lower plate for placement beneath the raised vented rib and between the raised vented rib and the weapon; means for drawing the upper plate and the lower plate together to clamp the upper plate and the lower plate to the raised vented rib; and at least a first stabilization and recoil reduction brace affixed to the upper plate.

18. The mounting device of claim 17 wherein the raised vented rib is elevated from the weapon by a post; and wherein the stabilization and recoil reduction brace comprises, in combination: a flat wall affixed to the upper plate; and a flat surface angled from the flat wall to fit between the raised vented rib and the weapon and to brace against the post.

19. The mounting device of claim 18 wherein the stabilization and recoil reduction brace further comprises, in combination: a slot formed in the flat wall, with the stabilization and recoil reduction brace affixed to the upper plate by a screw passing through the slot and threadably received in the upper plate allowing the flat wall to be extended and retracted relative to the upper plate.

20. Device for mounting sighting apparatus on weapons having a vented rib, with the vented rib being elevated from the weapons by a post, comprising, in combination: a mounting base; means for attaching the mounting base to the vented rib; and means for stabilizing the mounting base on the vented rib and for absorbing weapon recoil comprising at least a first brace removably affixed to the mounting base for pressing against the post.

21. The mounting device of claim 20 wherein the brace comprises, in combination: a flat wall affixed to the mounting base; and a flat surface angled from the flat wall to fit between the vented rib and the weapon and to press against the post.

22. The mounting device of claim 21 wherein the stabilizing and absorbing means includes means for adjusting the brace relative to the mounting base.

23. The mounting device of claim 22 wherein the adjusting means comprises, in combination: a slot formed in the flat wall of the brace; wherein the brace is affixed to the mounting base by a screw passing through the slot and threadably received in the mounting base allowing the flat wall of the brace to be extended and retracted relative to the mounting base.

24. Device for mounting sighting apparatus on weapons having a vented rib, with the vented rib being elevated from the weapon by a post, comprising, in combination: a mounting base; means for attaching the mounting base to the vented rib; and means for stabilizing the mounting base on the vented rib and for absorbing weapon recoil comprising at least a first brace affixed to the mounting base for pressing against the post, with the stabilizing and absorbing means including means for adjusting the brace relative to the mounting base.

* * * * *